US010443305B2

(12) United States Patent
Johnsen

(10) Patent No.: US 10,443,305 B2
(45) Date of Patent: Oct. 15, 2019

(54) DETACHABLE TRAY FOR A LADDER

(71) Applicant: Eric Johnsen, Framingham, MA (US)

(72) Inventor: Eric Johnsen, Framingham, MA (US)

( * ) Notice: Subject to any disclaimer, the term of this patent is extended or adjusted under 35 U.S.C. 154(b) by 356 days.

(21) Appl. No.: 15/206,380

(22) Filed: Jul. 11, 2016

(65) Prior Publication Data

US 2017/0009527 A1 Jan. 12, 2017

Related U.S. Application Data

(60) Provisional application No. 62/191,186, filed on Jul. 10, 2015.

(51) Int. Cl.
*E06C 7/14* (2006.01)

(52) U.S. Cl.
CPC ..... *E06C 7/14* (2013.01)

(58) Field of Classification Search
CPC ..... E06C 7/14; B65D 25/22; B65D 25/32; F16M 13/022
See application file for complete search history.

(56) References Cited

U.S. PATENT DOCUMENTS 2,784,869 A * 3/1957 Stein ..... A47J 47/16 220/762
5,079,795 A * 1/1992 Schmid ..... B44D 3/126 15/257.06
8,469,148 B2 * 6/2013 Perry ..... E06C 7/14 182/122
2003/0209387 A1 * 11/2003 Burr ..... E06C 7/14 182/129

* cited by examiner

*Primary Examiner* — Steven A. Reynolds
*Assistant Examiner* — Javier A Pagan
(74) *Attorney, Agent, or Firm* — Kriegsman & Kriegsman

(57) ABSTRACT

A detachable tray for a ladder includes a container for retaining supplies, a bracket assembly pivotally coupled to the container that is adapted to be releasably secured to the ladder, and a handle pivotally connected to the container to facilitate tray transport. The bracket assembly includes a rung engaging bracket that is movably connected to a base by a pair of transverse threaded members. A gap is defined between the bracket and the base that is dimensioned to fittingly receive one side rail of the ladder, the width of the gap being adjustable to accommodate side rails of varying widths. A support block is slidably coupled to a side of the base by a pair of posts. Together, the base and the support block apply a firm abutment force against the opposite side of the side rail than the bracket, thereby stabilizing the tray in place on the ladder.

17 Claims, 10 Drawing Sheets

DETACHABLE TRAY FOR A LADDER

FIELD OF THE INVENTION

The present invention relates generally to ladders and more particularly to trays that are adapted to be detachably mounted onto ladders.

BACKGROUND OF THE INVENTION

Ladders are commonly utilized in a variety of industries, such as painting and roofing, to provide access to an area at a considerable height. An extension ladder is one well-known type of ladder that includes a pair of parallel side rails interconnected by a plurality of transverse rungs. In use, a person disposes the bottom of the extension ladder on the ground and angles the top of the extension ladder against a support structure, such as a house. The person is then able to climb the ladder by sequentially stepping on the plurality of transverse rungs and thereby perform a particular task at a significant height above the ground.

When positioned on a ladder to perform a particular task, a person typically has limited accessibility to supplies, such as tools or materials. Rather, supplies are traditionally collected in a toolbox or other similar container which is kept on the ground. As such, a person is required to repeatedly climb up and down the ladder in order to access supplies from the toolbox that are needed to accomplish the particular task, which is both highly inefficient and labor intensive. Furthermore, repeatedly climbing up and down a ladder, especially while carrying multiple items, introduces an increased risk of falling, which can result in serious injury.

Accordingly, it is known in the art for workers to wear clothes and/or accessories (e.g., a toolbelt) that are designed to hold a limited number of small, frequently used instruments. However, it has been found that these types of tool retaining articles are somewhat uncomfortable to wear and significantly limit the number and size of tools that a worker can hold at any one time. These tool retaining articles may also cause the wearer to move into awkward positions to retrieve the tools, which can increase the risk of falling and experiencing serious injury.

Accordingly, it is known in the art for trays and other similar types of support structures to be detachably mounted onto a ladder at a user-selected height. A detachable ladder tray is typically constructed to mount on a side rail of an extension ladder and extend laterally outward therefrom so as not to interfere with the person when positioned on the ladder. The ladder tray is commonly constructed with a generally flat, shallow shelf that is provided with one or more openings through which tools can be hung. In this capacity, the worker can readily access items from the tray while positioned on the ladder.

In U.S. Pat. No. 8,469,148 to C. C. Perry, which is incorporated herein by reference, there is disclosed a tray for supporting tools, paint cans, painting supplies and the like that is pivotally held in a selected position by an elongated frame which is removably attached to a ladder rail. The ladder tray includes a folding shelf, a shelf support, a rail embracing frame, a hinge means connecting the shelf and support to the frame, and hooks for engaging the rungs of the ladder. A variety of apertures, depressions and/or raised areas exist on the tray in various sizes and shapes and are adapted for holding tools or for temporary placement of cans, bottles, jugs, tools and the like on the shelf. When mounted, the ladder tray extends out from one side of the ladder and does not prevent a user from climbing up or down the ladder. It may be folded down alongside the rail of the ladder to a space saving transport or storage position or may be folded and removed from the ladder to store.

Ladder trays of the type as described in the '148 patent have been found to suffer from a several notable drawbacks.

As a first drawback, ladder trays of the type as described in the '148 patent are incapable of being disposed on a flat surface while loaded with the various instruments due to its inverted L-shaped configuration. Rather, the tray is designed to be mounted onto a ladder at a user-selected height without any tools retained thereon. Subsequent thereto, the user would be required to climb up and down the ladder to retrieve the tools to be held by the tray, which is highly time-consuming and labor-intensive. This drawback also introduces additional hazards to the user, who may have to carry one or more items while simultaneously climbing up and down the ladder, often multiple times, thereby increasing the risk of falling and experiencing significant injury. It also requires that the various tools to be retained by the tray are removed therefrom between uses (e.g., when stored on a truck), thereby rendering the user less ready to perform a future task.

As a second drawback, ladder trays of the type described in the '148 patent are not designed to retain larger items, such as automated drills, nail guns and the like. As a result, routinely used items which are relatively large in size are only able to be disposed flat on the relatively small and shallow shelf in an unbalanced manner.

As a third drawback, ladder trays of the type as described in the '148 patent are not typically provided with a handle and, as such, are relatively difficult to carry when transporting up and down a ladder.

As a fourth drawback, ladder trays of the type as described in the '148 patent are typically designed for use with a particular size and shape of ladder. In particular, the portion of the ladder tray that directly engages the ladder is typically rigid and dimensionally fixed in construction and is therefore incapable of being adjusted to accommodate ladders of varying rail widths.

As a fifth drawback, ladder trays of the type as described in the '148 patent are often secured to ladders in a relatively unstable fashion. For instance, as noted above, the inability to adjust conventional ladder trays to fittingly mount on ladders of varying dimensions and different rail configurations often renders the ladder tray unstable and unreliable as a support structure. Additionally, conventional ladder trays that are designed to hook onto one or more ladder rungs often fail to restrict lateral and/or rotational movement of the tray. As can be appreciated, limited lateral and/or rotational movement of the tray relative to the ladder can cause equipment on the tray, or the tray itself, to fall, creating a potentially dangerous condition.

SUMMARY OF THE INVENTION

It is an object of the present invention to provide a new and improved tray that is adapted for detachable securement to a ladder.

It is another object of the present invention to provide a tray as described above that secures to ladders of varying sizes and styles.

It is yet another object of the present invention to provide a tray as described above that secures to ladders in a highly stable fashion.

It is still another object of the present invention to provide a tray as described above that is easy to load with equipment and effortless to transport.

It is yet still another object of the present invention to provide a tray as described above that is limited in parts, inexpensive to manufacture, and simple to use.

Accordingly, as one feature of the present invention, there is provided a tray for releasable securement to a ladder, the ladder comprising a pair of parallel side rails interconnected by a plurality of transverse rungs, the tray comprising (a) a container adapted to retain supplies, and (b) a bracket assembly coupled to the container, the bracket assembly being adapted to releasably engage the ladder, (c) wherein the bracket assembly can be dimensionally adjusted to compensate for variances in size of the ladder to which the tray is secured.

Various other features and advantages will appear from the description to follow. In the description, reference is made to the accompanying drawings which form a part thereof, and in which is shown by way of illustration, an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE INVENTION

Construction of Tray 11

Figure 1:
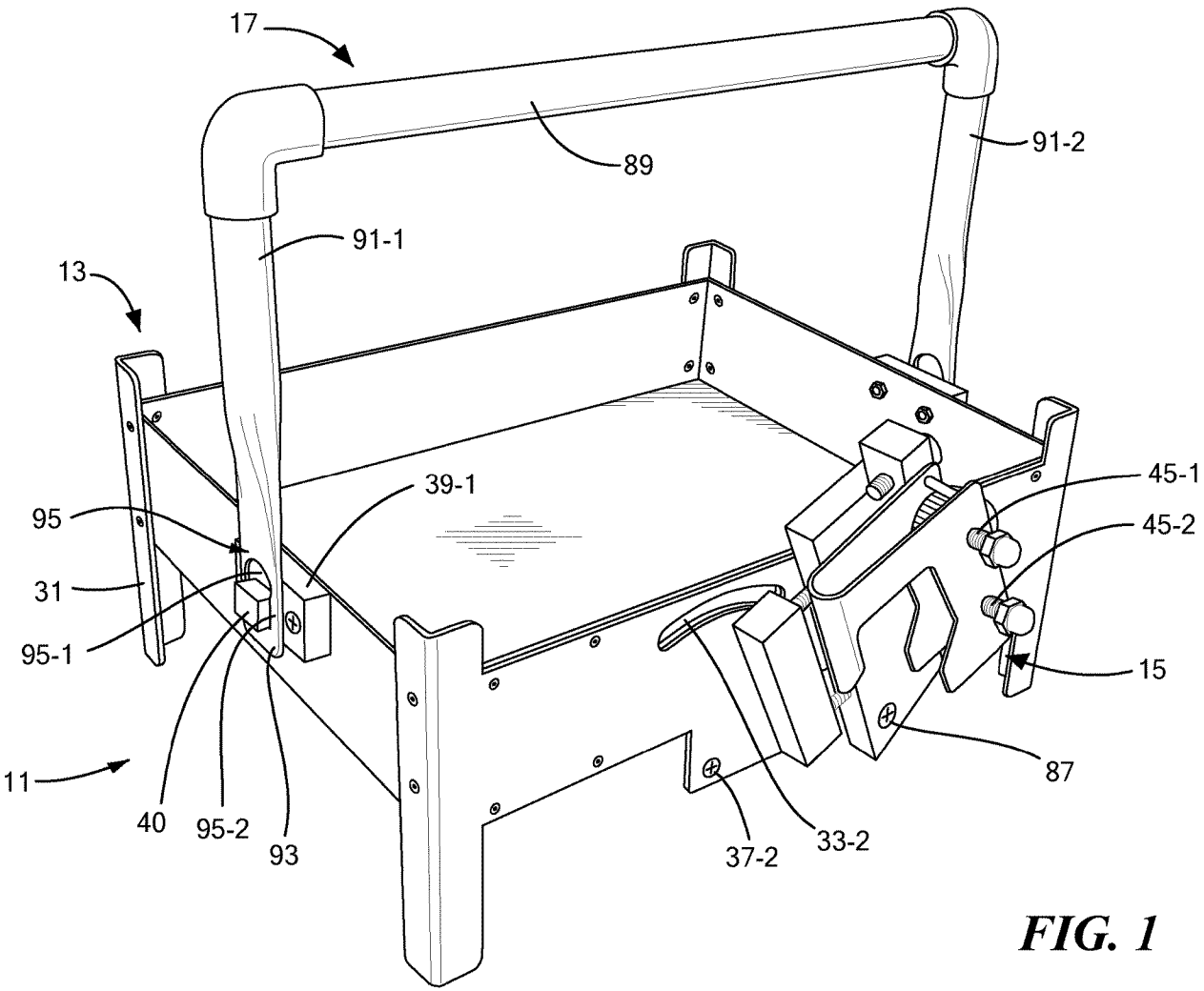
FIG. 1 is a front perspective view of a detachable tray for a ladder, the detachable tray being constructed according to the teachings of the present invention.

Referring now to FIG. 1, there is shown a front perspective view of a tray for retaining supplies, the tray being constructed according to the teachings of the present invention and identified generally by reference numeral 11. As will be described in greater detail below, tray 11 is designed to be removably mounted onto a conventional ladder in a simple and efficient manner, thereby providing a user positioned on the ladder with readily available access to the supplies collected thereon. As a principal feature of the present invention, tray 11 can be adjusted, as needed, to allow for its reliable and stable securement to a wide variety of different ladder shapes and styles.

As defined herein, use of the term "supplies" denotes any tool or material that is commonly utilized by a worker disposed on a ladder. Specific examples of supplies which may be retained by tray 11 include, but are not limited to, paint products, paint tools, hand tools, power tools, hardware and the like.

Tray 11 is a unitary and rigid member that includes a supply retaining container 13, an adjustable, ladder mounting bracket assembly 15 slidably coupled to container 13, and a handle 17 pivotally coupled to container 13.

Figure 2:
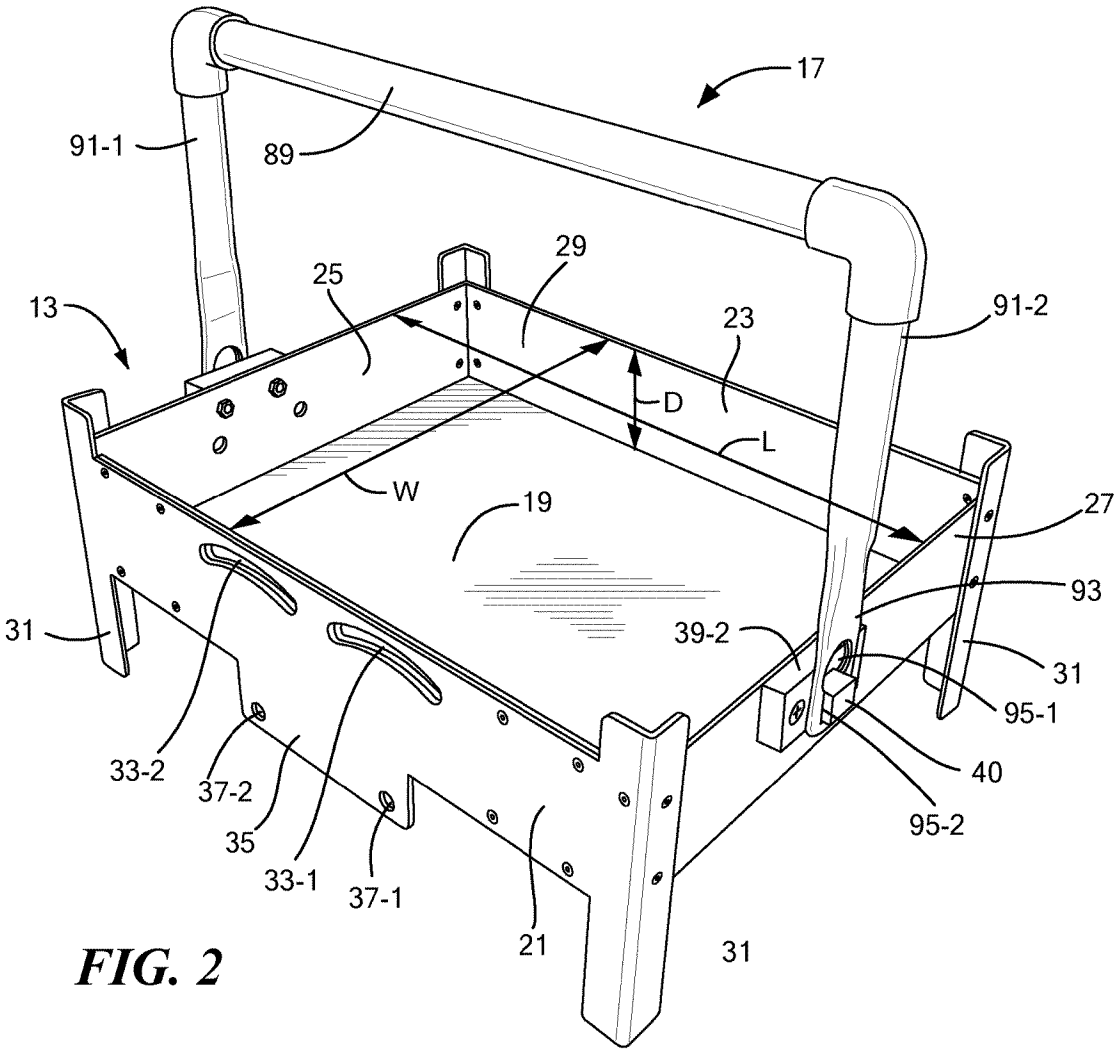
FIG. 2 is a front perspective view of the detachable tray shown in FIG. 1, the tray being shown with the bracket assembly removed therefrom in order to show certain details of the container.

As seen most clearly in FIGS. 1 and 2, container 13 is a five-sided, open box-shaped member that is preferably constructed of a rigid material, such as aluminum or hard plastic, to enhance its durability and structural integrity. Container 13 includes a generally rectangular bottom panel 19, front and rear panels 21 and 23 which extend from the front and rear edges, respectively, of bottom panel 19 in an orthogonal relationship relative thereto, and a pair of side panels 25 and 27 which extend from opposing side edges of bottom panel 19 in an orthogonal relationship relative thereto.

Together, panels 19, 21, 23, 25 and 27 define an interior cavity 29 that is bounded on five sides. Interior cavity 29 preferably has a length L of approximately 16 inches, a width W of approximately 12 inches and a depth D of approximately 3 inches. In this capacity, interior cavity 29 is appropriately dimensioned to receive through its open top end a wide range of commonly used supplies, including larger, motor-driven handheld tools. It should be noted that the depth D of interior cavity 29 ensures that instruments disposed therein are adequately retained by panels 21, 23, 25 and 27 and are thereby less susceptible to inadvertently fall out therefrom.

Container 13 is additionally shaped to define four support members 31, each generally L-shaped in cross-section, which protrude slightly above its open top end. As can be seen, support members 31 also extend a fixed distance (approximately 3 inches) downward from the four corners of bottom panel 19. In this manner, support members 31 function as feet that enable container 13 to be placed on a flat surface (e.g., a table, the ground, or a truck bed) in a stable fashion. As a result, supplies relied upon by the user can be retained within interior cavity 29 between uses (i.e. without requiring the frequent loading and unloading of instruments each time tray 11 is used). By contrast, conventional ladder trays that include fitted openings through which tools are disposed often cannot be easily stored or transported with equipment retained therein.

A pair of arcuate slots 33-1 and 33-2 is formed in front panel 21. As can be seen, slots 33 extend side-by-side in a generally horizontal relationship. As will be explained further below, slots 33 enable bracket 15 to be slidably coupled thereto.

A planar support plate 35 is integrally formed onto and extends down from the bottom edge of front panel 21 directly beneath arcuate slots 33. Support plate 35 is shaped to define a pair of holes 37-1 and 37-2, each hole 37 being generally circular in cross-section. As can be seen, holes 37-1 and 37-2 align directly beneath the center of slots 33-1 and 33-2, respectively. Together, slot 33-1 and hole 37-1 serve as complementary openings for mounting bracket assembly 15 onto container 13 in such a manner that tray 11 can be installed onto the right side rail of a ladder. Similarly, slot 33-2 and hole 37-2 serve as complementary openings for mounting bracket assembly 15 onto container 13 in such a manner that tray 11 can be installed onto the left side rail of a ladder. In this manner, tray 11 is adapted to be mounted onto either side rail of a ladder, which is highly desirable.

Container 13 additionally comprises a pair of handle support blocks 39-1 and 39-2 that extends orthogonally out from the outer surfaces of side panels 25 and 27, respectively. Each support block 39 includes a projection 40 that is square-shaped in transverse cross-section. As will be explained further below, projection 40 enables handle 17 to be selectively locked in a generally vertical orientation.

Although not shown herein, it is to be understood that container 13 could be configured to include a slidable drawer within at least one of side panels 25 and 27 without departing from the spirit of the present invention. Such a drawer would preferably define an inner cavity that is appropriately dimensioned to hold a plurality of small items, such as screws, nails and other similar fastening elements.

As referenced briefly above, mounting bracket 15 is slidably coupled to container 13 and enables tray 11 to be releasably secured to a conventional ladder. As will be explained in detail below, mounting bracket 15 is uniquely designed to adjust for variances in ladder rail width and, in addition, stabilize tray 11 in place on a ladder so as to prevent any undesired twisting, rocking or other similar movement.

Figure 3:
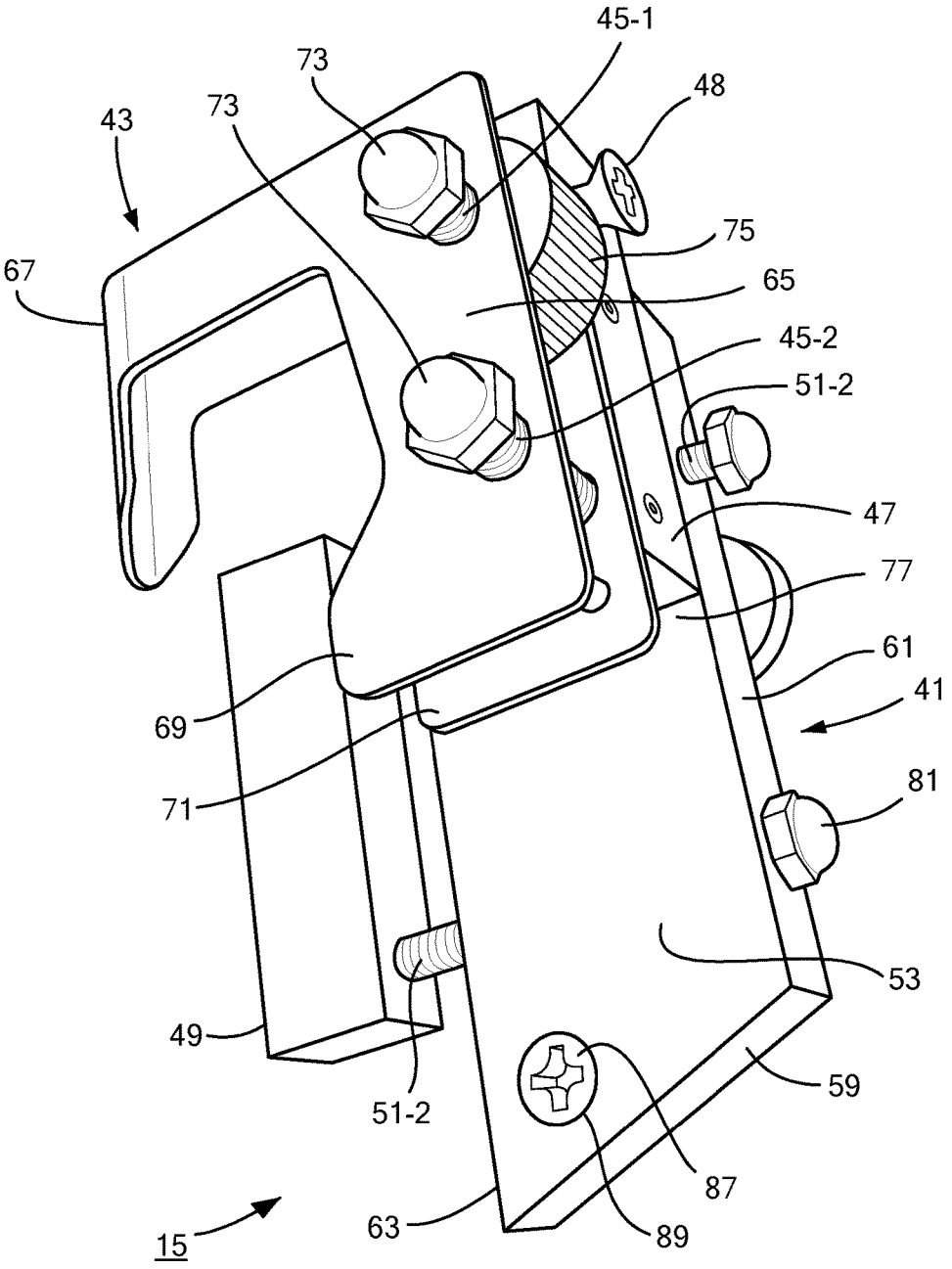
FIG. 3 is a front perspective view of the bracket assembly shown in FIG. 1.
Figure 4:
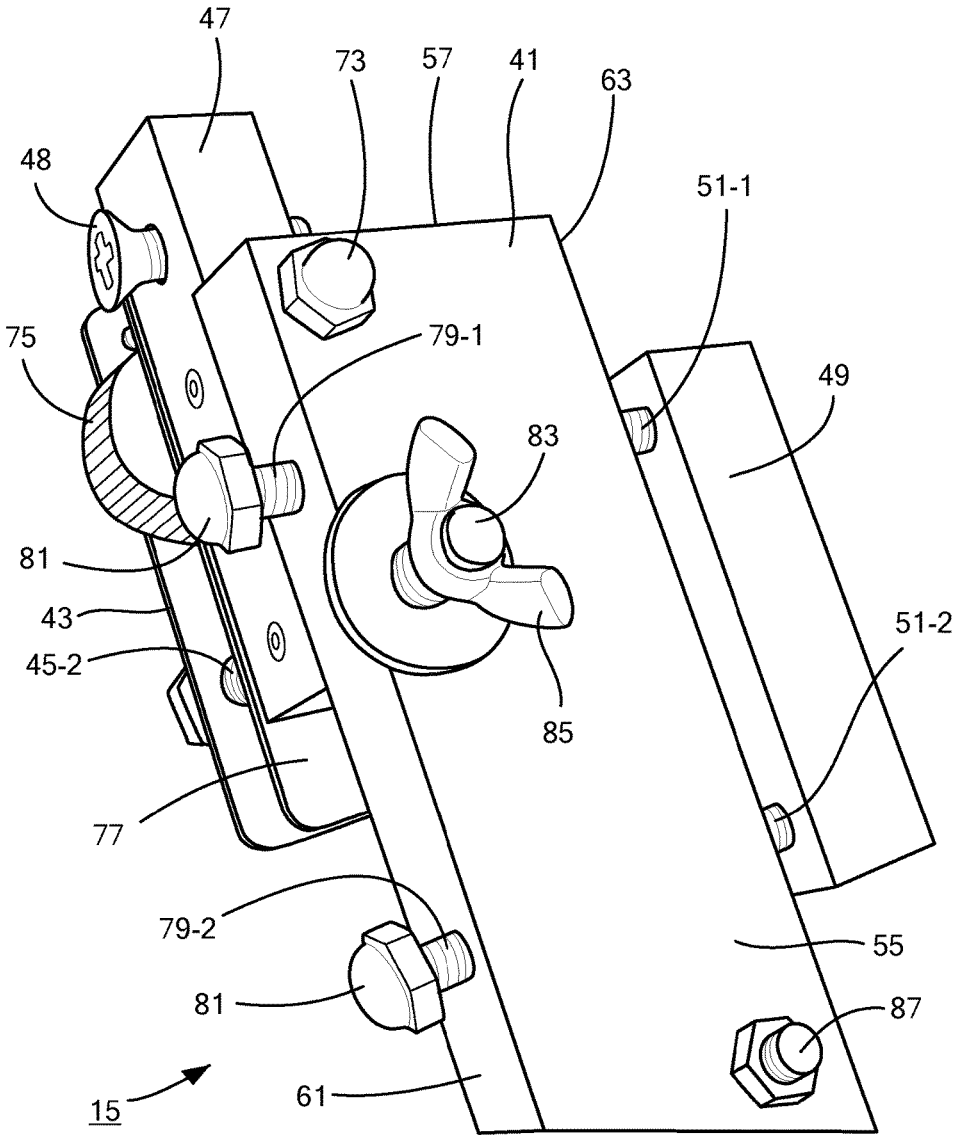
FIG. 4 is a rear perspective view of the bracket assembly shown in FIG. 3.
Figure 5A:
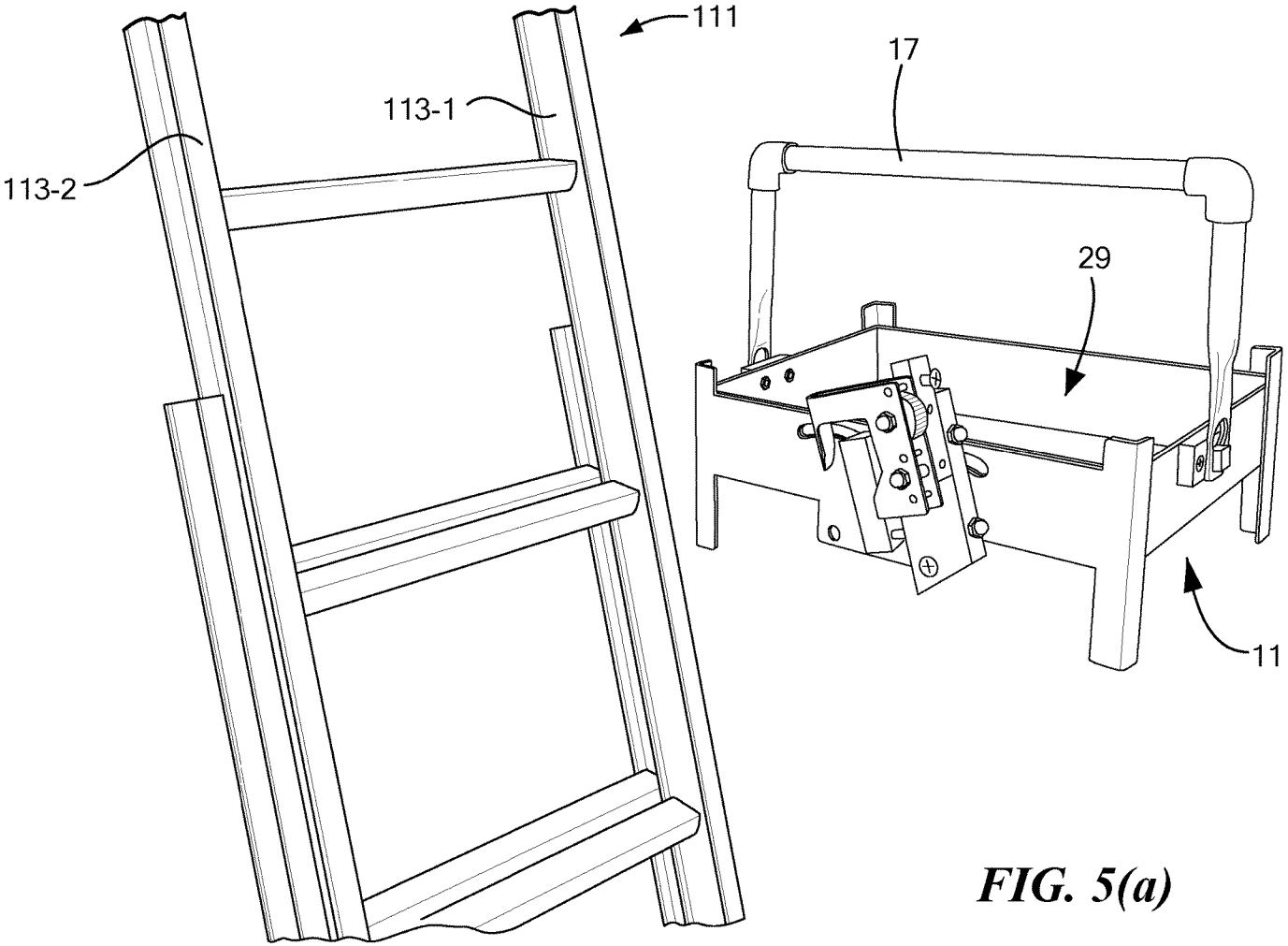
FIGS. 5(*a*)-(*f*) are front perspective views of the detachable tray shown in FIG. 1, the detachable tray being shown at various stages during its mounting on an extension ladder.
Figure 5B:
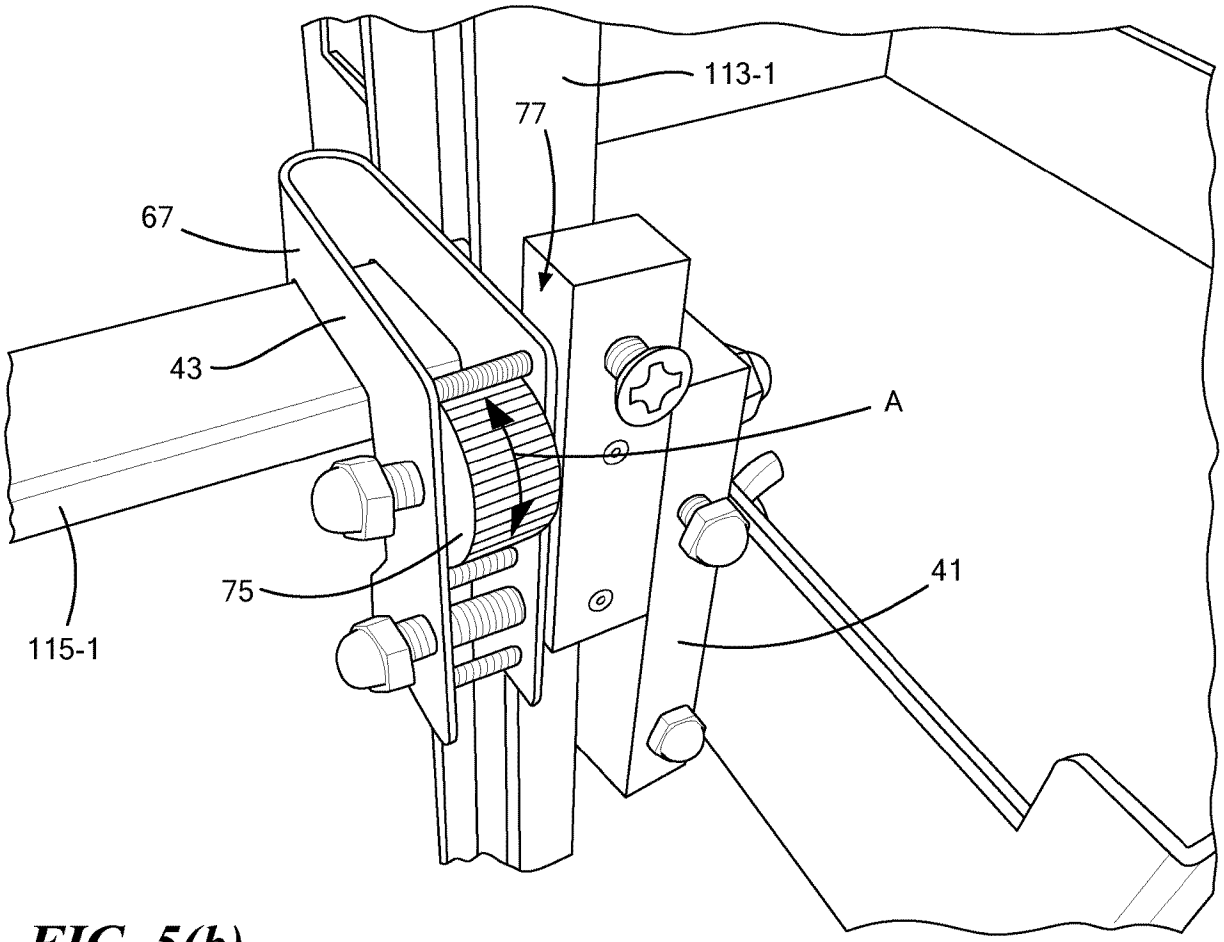
Figure 5C:
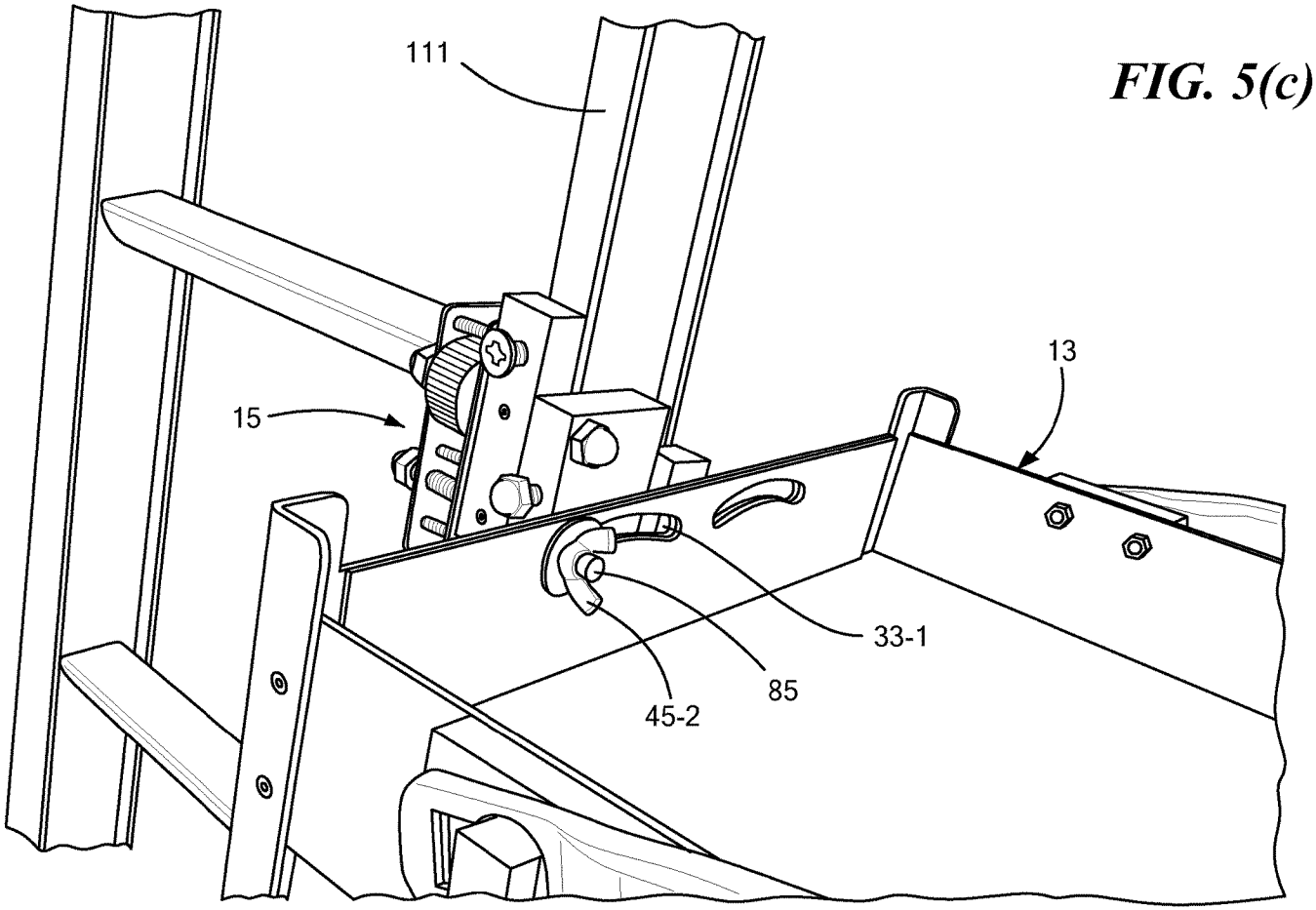
Figure 5D:
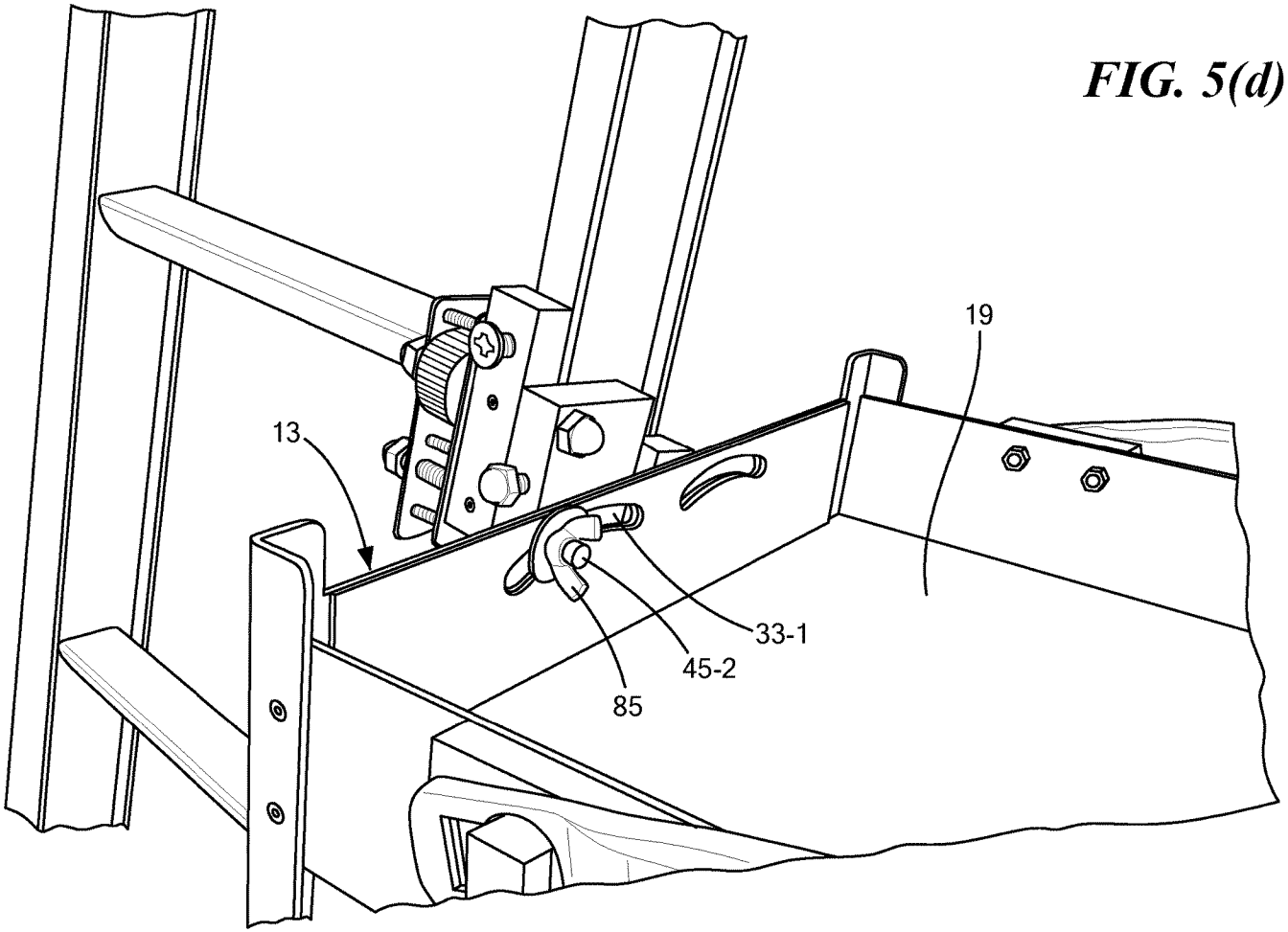
Figure 5E:
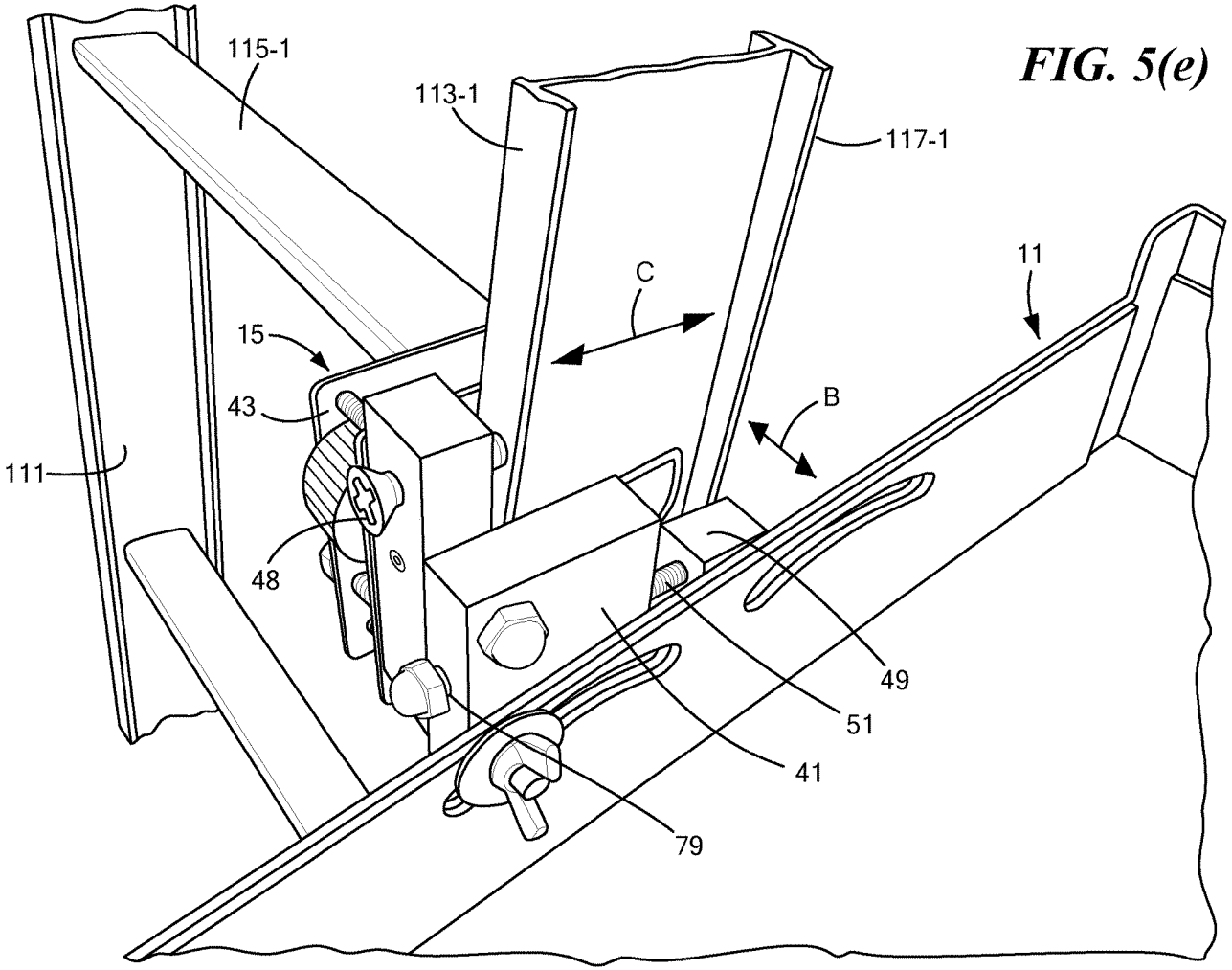
Figure 5F:
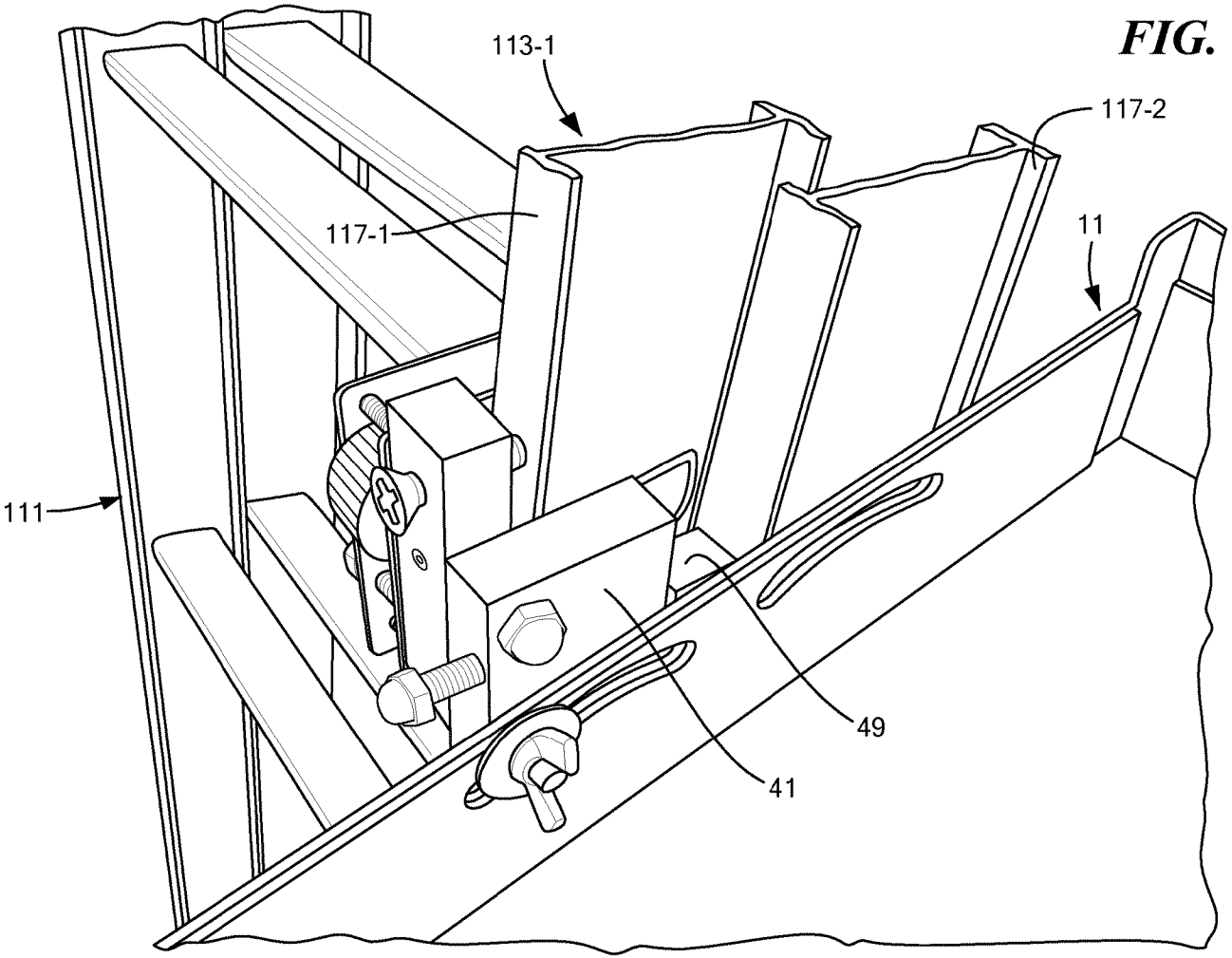

Referring now to FIGS. 1, 3, and 4, bracket assembly 15 comprises a base 41, a bracket 43 connected to base 41 by a pair of parallel threaded members 45-1 and 45-2, a spacer block 47 mounted onto base 41 so as to separate bracket 43 a defined minimum distance therefrom, and a support block, or piston, 49 slidably coupled to base 41 by a pair of parallel posts 51-1 and 51-2.

Base 41 is preferably constructed as a generally solid block that includes a planar front wall 53, a planar rear wall 55, a top wall 57, a bottom wall 59, a first side wall 61 and a second side wall 63. As will become apparent below, base 41 serves as the primary support structure on which other components of bracket assembly 15 are mounted.

Bracket 43 is a generally L-shaped member that includes an elongated vertical portion 65 from which extends a hook-shaped finger 67. Accordingly, with tray 11 properly mounted on a ladder, bracket 43 is dimensioned to receive a transverse rung such that finger 67 hooks around and securably engages the top of the rung, as will be described further below.

Vertical portion 65 of bracket 43 additionally includes front and rear panels 69 and 71 that are spaced apart from one another a fixed distance. As can be seen, vertical portion 65 of bracket 43 is coupled to base 41. Specifically, externally threaded parallel members 45 extend transversely through front and rear walls 53 and 55 of base 41 (preferably through preformed bores) and, in turn, through front and rear panels 69 and 71 of vertical portion 65. An internally threaded, hexigonal cap 73 is mounted onto selected distal ends of parallel members 45 to retain base 41 and bracket 43 coupled together.

It should be noted that base 41 is fixedly mounted onto parallel members 45, whereas bracket 43 is able to move axially along members 45 in either direction towards or away from base 41. In this manner, the spacing between base 41 and bracket 43 can be adjusted to compensate for variances in ladder side rail width, as will be explained further below.

An adjustment wheel 75 is axially mounted on member 45-1 in a fitted relationship between front and rear panels 69 and 71 of vertical portion 65, the width of wheel 75 being approximately the width between panels 69 and 71. Wheel 75 is internally threaded so as to engage the external threading on member 45-1. Accordingly, through manual rotation of wheel 75, a portion of which remains externally accessible for manipulation, bracket 43 can be displaced along members 45 towards or away from base 41, depending upon the direction of rotation of wheel 75.

Spacer block, or spacer, 47 is mounted on members 45 and is fixedly secured to front wall 53 of base 41. A screw 48 extends transversely through spacer 47, in the direction from its right side wall to its left side wall, and provides additional stabilization of tray 11 when mounted on a ladder, as will be explained further below.

As noted above, base 41 and bracket 43 together define an adjustable spacing, or gap, 77 that is appropriately dimensioned to fittingly receive one side rail of a conventional ladder. Because the side rails for conventional ladders can vary in width, gap 77 between bracket 43 and base 41 can be modified, as needed, through manual rotation of wheel 75. The inclusion of spacer 47 ensures that bracket 43 and base 41 are separated a predefined minimum distance, which may correspond to the most common, or standard, width of ladder side rails.

As referenced briefly above, support block 49 is slidably coupled to base 41 by a pair of parallel posts 51-1 and 51-2. Support block 49 is preferably constructed as a generally rectangular solid block of material and, in use, serves to stabilize, or secure, tray 11 on a ladder, as will be explained further below.

Posts 51-1 and 51-2 are axially inserted through corresponding bores 79-1 and 79-2 which extend transversely through base 41 from side wall 61 to side wall 63. Each bore 79 is circular in transverse cross-section and is dimensioned to receive a corresponding post 51 such that each post 51 is able to slide axially within its bore 79 with limited friction.

Support block 49 is fixedly mounted onto one end of each post 51. Additionally, an internally threaded cap 81 is fixedly mounted onto the opposite end of each post 51. As such, block 49 and caps 81 enable posts 51 to slide freely within bores 79 without risk of disassembly.

Referring back to FIG. 1, bracket assembly 15 is preferably mounted onto container 13 in the following manner. As referenced above, container 13 is designed to enable bracket assembly 15 to be coupled thereto in two different ways. As a consequence, tray 11 is adapted to be mounted on either the right rail or the left rail of a ladder, depending on user preference.

As represented herein, free end 83 of member 45-2 is shown inserted laterally inward through slot 33-1 so as to render tray 11 configured for mounting on the right rail of a ladder. As seen most clearly in FIG. 4, an enlarged knob 85 (represented herein as the combination of a washer and a wingnut) is threadingly mounted onto free end 83 in engagement therewith so as to lock the position of member 45-2 within slot 33-1.

Additionally, a pivot pin 87 is shown inserted through a transverse hole 89 in base 41 as well as through hole 37-1 in container 13. Accordingly, bracket assembly 15 is adapted to pivot about pin 87, with member 45-2 free to travel within arcuate slot 33-1 in order to position container 13 in a generally horizontal orientation when mounted on a ladder. Once container 13 is properly oriented, knob 85 can be tightened to lock the position of container 13. As can be appreciated, this pivotable adjustability of container 13 compensates for variances in the pitch of the ladder on which tray 11 is mounted (i.e. the angle of the ladder relative to ground).

As noted above, FIG. 1 depicts tray 11 in its assembled state for mounting onto the right rail of a ladder. However, it is to be understood that bracket assembly 15 could be similarly coupled to container 13 using slot 33-2 and hole 37-2 to enable tray 11 to be readily mounted onto the left rail of a ladder (e.g. for left-handed users) without departing from the spirit of the present invention.

Handle 17 is coupled to container 13 and is adapted to be pivoted between a generally vertical orientation suitable for transporting tray 11, as shown in FIG. 1, and a less intrusive horizontal position, which provides the user with greater access to tools retained within cavity 29 (e.g. when tray 11 is mounted on a ladder). As will be explained below, handle 17 is designed to be selectively locked in a vertical orientation, which serves as a feature of the present invention.

As shown in FIGS. 1 and 2, handle 17 is constructed as a unitary, U-shaped member that includes an elongated rod 89 from which downwardly extends a pair of opposing, parallel cross-arms 91-1 and 91-2, each cross-arm 91 terminating into a flattened paddle 93.

Each paddle 93 is shaped to define a keyhole-shaped punch out, or hole, 95. Namely, punch out 95 includes a circular portion 95-1 disposed directly above a square-shaped portion 95-2 that is in communication therewith.

Each punch out 95 is designed to receive a corresponding projection 40 on container 13. With each projection 40 located within circular portion 95-1 of its corresponding punch out 95, handle 17 is able to rotate freely between a horizontal position and a vertical position. However, with handle 17 lifted slightly upward such that each projection 40 aligns within square-shaped portion 95-2 of its corresponding punch out 95, handle 17 is effectively locked in a vertical orientation. To then unlock handle 17 and therefore allow for its rotation, handle 17 is urged slightly downward until each projection 40 aligns back within circular portion 95-1 of its corresponding punch out 95.

Use of Tray 11 with a Ladder

Referring now to FIGS. 5(*a*)-(*f*), tray 11 is designed to be mounted on an extension ladder 111 in the following manner. Specifically, as referenced above, tray 11 is capable of being mounted on either the right side rail 113-1 or left side rail 113-2 of ladder 111, depending upon the user preference. Upon selecting the desired side rail 113 on which tray 11 is to be mounted, bracket assembly 15 is coupled to container 13 using the proper slot 33 and hole 37, as referenced above.

Once bracket assembly 15 is coupled to container 13 in the desired configuration, tray 11 is preferably disposed on a flat surface (e.g., the ground) and loaded with the various supplies that are needed to perform the intended task. With the necessary supplies disposed in cavity 29, the user grasps tray 11 by vertically disposed handle 17 and approaches ladder 111, as shown in FIG. 5(*a*).

With handle 17 preferably locked in its vertical orientation to facilitate handling, tray 11 is mounted on ladder 111 at the desired height. Specifically, tray 11 is disposed such that finger 67 wraps around and engages a rung 115-1 situated at the desired height, as shown in FIG. 5(*b*). Disposed as such, right side rail 113-1 fittingly projects into the gap 77 defined between bracket 43 and base 41.

As referenced above, wheel 75 can be manually rotated in either direction to widen or narrow the width of gap 77, as represented by arrow A in FIG. 5(*b*). In this manner, tray 11 is suitably designed to accommodate side rails of various widths, which is an object of the invention. Further, it should be noted that rotating wheel 75 such that bracket 43 and base 41 tightly sandwich side rail 113-1 serves to retain tray 11 on ladder 111 in a secure fashion (i.e. to prevent any wobbling of tray 11).

With bracket 15 engaged with ladder 111 in the manner set forth above, the orientation of container 13 may not be optimal for retaining articles, as shown in FIG. 5(*c*). Accordingly, orientation of container 13 can be adjusted by loosening knob 85 and, in turn, pivoting container 13 such that member 45-2 travels within arcuate slot 33-1. Once container 13 is pivoted to the desired orientation (e.g. such that bottom panel 19 is horizontally disposed), knob 85 is preferably tightened so as to lock the position of container 13, as shown in FIG. 5(*d*).

As a feature of the present invention, bracket assembly 15 includes piston 49 to support tray 11 on ladder 111 in a stable and secure fashion. Specifically, as shown in FIG. 5(*e*), support block 49 is designed to directly abut against the rear, outer portion of side rail 113-1. Similarly, with tray 11 mounted on ladder 111, bracket 43 is disposed in direct abutment against the front, inner portion of side rail 113-1. These counteracting forces applied to side rail 113-1 prevent any lateral rotation or twisting of tray 11 on ladder 111, as depicted by arrows B in FIG. 5(*e*), which would result in the instability of tray 11.

In a similar fashion, with tray 11 mounted on ladder 111, finger 67 of bracket 43 wraps around the rear portion of rung 115-1. Additionally, screw 48 in spacer 47 can be driven into abutment against the front of side rail 113-1. These counteracting forces applied to ladder 111 prevent any forward-rearward rocking of tray 11 on ladder 111, as depicted by arrows C in FIG. 5(*e*).

It is important to note that posts 51 are designed to freely slide within bores 79 in base 41. As a result of the slight downward orientation of posts 51, gravitational forces naturally extend support block 49 away from base 41 to the extent necessary to abut against the rear, outer portion of side rail 113-1, which is highly desirable.

Commonly, extension ladders 111 are constructed with side rails 113 that include partially overlapping inner and outer sections 117-1 and 117-2 that are slidably coupled together, as shown in FIG. 5(*f*). Sections 117-1 and 117-2 are then selectively locked in position relative to each other in order to modify the overall length of ladder 111. The particular manner for stabilizing tray 11 on an extension ladder 111 with this particular construction is dependent upon whether tray 11 is mounted on the region of ladder 111 that includes overlapping inner and outer sections 117-1 and 117-2.

In FIG. 5(*e*), tray 11 is shown mounted on the region of ladder 111 that includes only inner section 117-1. In this region, support block 49 abuts against side rail 113-1 in the manner set forth in detail above.

However, it is to be understood that support block 49 is incapable of abutting against the rear, outer portion of inner section 117-1 when tray 11 is mounted on the overlapped region of side rail 113-1 (i.e. the portion of side rail 113-1 that includes both inner and outer sections 117-1 and 117-2). Specifically, because outer section 117-2 overlies inner section 117-1, the rear, outer region of inner section 117-1 is not exposed for contact by support block 49.

As a result, when bracket assembly 15 is mounted on the overlapping region of a side rail 113-1, as shown in FIG. 5(*f*), support block 49 is designed to slide into abutment against the front surface of outer section 117-2 of side rail 113-1 and thereby provide the necessary counteracting force to stabilize tray 11. As in the previous mounting example, support block 49 is designed to extend into abutment with outer section 117-2 by means of natural gravitation forces (i.e. due to the downward angle of posts 51). As a consequence, proper setup is quick and easy, which is highly desirable.

With tray 11 properly mounted on ladder 111 in the manner set forth above, the user can perform the desired task on ladder 111 and easily access articles retained within container 13. To facilitate access to the articles while mounted on ladder 111, handle 17 is preferably pivoted down from its vertical orientation.

Upon completion of the particular task, handle 17 can be repositioned into its vertical orientation. Thereafter, the user can disengage tray 11 from ladder 111 by simply lifting handle 17 upward. Tray 11 can then be reinstalled on ladder 111 at any desired height by repeating the mounting process set forth in detail above.

The embodiment shown above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A tray for releasable securement to a ladder, the ladder comprising a pair of parallel side rails interconnected by a plurality of transverse rungs, the tray comprising:

(a) a container adapted to retain supplies; and (b) a bracket assembly coupled to the container, the bracket assembly being adapted to releasably engage the ladder, the bracket assembly comprising, (i)a base, and (ii) a bracket separate from and movably connected to the base, the bracket including a finger that is adapted to engage one of the plurality of transverse rungs of the ladder to which the tray is secured;

(c) wherein a gap is defined between the base and the bracket, the gap being dimensioned to fittingly receive one of the pair of side rails of the ladder to which the tray is secured, the gap having a width that can be adjusted to compensate for variances in size of the ladder to which the tray is secured.

2. The tray of claim 1 wherein the bracket assembly is adapted to directly abut against opposing surfaces of one of the pair of side rails of the ladder to which the tray is secured.

3. The tray of claim 2 wherein the bracket assembly further includes a spacer coupled to the base for maintaining a minimum width of the gap defined between the base and the bracket.

4. The tray of claim 2 wherein the bracket is coupled to the base by a threaded member.

5. The tray of claim 4 wherein the bracket assembly comprises an adjustment wheel mounted on the threaded member, whereby rotation of the adjustment wheel displaces the bracket axially along the threaded member relative to the base.

6. The tray of claim 2 wherein the bracket assembly further comprises a support block slidably coupled to the base by at least one post.

7. The tray of claim 1 wherein the container is an open box-shaped member that includes a bottom panel, a front panel, a rear panel and a pair of side panels that together define an interior cavity.

8. The tray of claim 7 wherein the container includes a plurality of support members which enable the container to be placed on a flat surface.

9. The tray of claim 1 wherein the bracket assembly is pivotally coupled to the container.

10. The tray of claim 9 wherein the container is shaped to define an arcuate slot and a circular hole.

11. The tray of claim 10 wherein the bracket assembly includes a first member that protrudes through the arcuate slot and a pivot pin that fittingly protrudes through the circular hole.

12. The tray of claim 11 wherein the bracket assembly pivots about the pivot pin protruding through the circular hole in the container, the bracket assembly pivoting along the path defined by the first member traveling within the arcuate slot.

13. The tray of claim 1 further comprising a handle coupled to the container, the handle comprising a pair of ends.

14. The tray of claim 13 wherein the handle is adapted to pivot relative to the container.

15. The tray of claim 14 wherein the handle is adapted to be locked in a generally vertical orientation.

16. The tray of claim 15 wherein each end of the handle includes an opening with an upper portion and a lower portion.

17. The tray of claim 16 wherein the container comprises a pair of projections that are square-shaped in transverse cross-section, each of the pair of projections being dimensioned to fittingly protrude through the lower portion of the opening in each end of the handle.

* * * * *